US009145720B2

(12) United States Patent
Chang et al.

(10) Patent No.: US 9,145,720 B2
(45) Date of Patent: Sep. 29, 2015

(54) MAGNETIC LOCKING APPARATUS

(71) Applicant: DOOR & WINDOW HARDWARE CO., Taichung (TW)

(72) Inventors: Wei-Hung Chang, Taichung (TW); Chih-Lun Hsieh, Taichung (TW)

(73) Assignee: DOOR & WINDOW HARDWARE CO., Taichung (TW)

( * ) Notice: Subject to any disclaimer, the term of this patent is extended or adjusted under 35 U.S.C. 154(b) by 236 days.

(21) Appl. No.: 13/804,591

(22) Filed: Mar. 14, 2013

(65) Prior Publication Data

US 2014/0265362 A1 Sep. 18, 2014

(51) Int. Cl.

| | |
|---|---|
| ***E05C 1/10*** | (2006.01) |
| ***E05C 1/16*** | (2006.01) |
| *E05C 17/56* | (2006.01) |

(52) U.S. Cl.

CPC ..... *E05C 1/16* (2013.01); *Y10T 292/0997* (2015.04)

(58) Field of Classification Search

USPC ..... 292/175, 251.5

See application file for complete search history.

(56) References Cited

U.S. PATENT DOCUMENTS

| | | | | |
|---|---|---|---|---|
| 3,586,361 | A * | 6/1971 | Ohno | 292/169 |
| 5,925,861 | A * | 7/1999 | Fromberg | 200/61.67 |
| 6,474,120 | B1 * | 11/2002 | Wadsworth et al. | 70/276 |

* cited by examiner

*Primary Examiner* — Mark Williams

(74) *Attorney, Agent, or Firm* — Muncy, Geissler, Olds & Lowe P.C.

(57) ABSTRACT

A magnetic locking apparatus has a body and an engaging mount. The body has a casing, a bolt and a driving device. The bolt is retractably mounted in the casing and has a connecting section, an engaging section and at least one magnetic element. The driving device is mounted in the casing and has a handle mount. The engaging mount faces the casing and the bolt and has a locking hole and at least one magnetic element mounted at two sides of the locking hole to attract the at least one magnetic element of the bolt.

17 Claims, 9 Drawing Sheets

MAGNETIC LOCKING APPARATUS

BACKGROUND OF THE INVENTION

1. Field of the Invention

The present invention relates to a magnetic locking apparatus, and more particularly relates to a magnetic locking apparatus that can be assembled on a door conveniently.

2. Description of Related Art

A conventional locking apparatus has a body and a strike plate. The body is mounted on a door and has a retractable bolt. The bolt extends out of a side of the body under an unforced condition. The strike plate is mounted on a side of a door frame corresponding to the body and has a locking hole formed through a middle of the strike plate. When the door is closed, the body is moved with the door toward the door frame, and the bolt will hit the strike plate and move into the body to enable the door to close relative to the door frame. As the door moves relative to the door frame to enable the bolt to align with the locking hole of the strike plate, the bolt will extend out of the body again and move into the locking hole of the strike plate. However, the bolt and the strike plate are made of metal and thus will generate noise when the bolt hits the strike plate. In order to reduce noise, a conventional magnetic locking apparatus is designed, with reference to FIG. 9, a bolt 60 is mounted in a body of the conventional magnetic locking apparatus without extending out of the body under an unforced condition and has a center and a magnetic element 62 mounted in the center of the bolt 60. The strike plate 70 is mounted on the door frame and has a center and a magnetic element 72. The magnetic element 72 is mounted on and protrudes from the center of the strike plate 70 and extends into the door frame. When the door is rotated to close relative to the door frame, the bolt 60 will not hit the strike plate 70, thereby avoiding generating noise. As the door is closed relative to the door frame, the magnetic elements 62, 72 will attract each other by magnetic forces. Then, the bolt 60 will move out of the body and move into the locking hole of the strike plate 70 to enable the door to be held in position with the door frame. According to the above-mentioned structures and operation, the conventional magnetic locking apparatus can be used to reduce noise.

However, the magnetic elements 62, 72 of the conventional magnetic locking apparatus are respectively mounted in the centers of the bolt 60 and the strike plate 70. Then, the door frame has to be made into a thickness sufficient for a depth of a mounting recess so as to contain the strike plate 70 and the magnetic element 72. If the thickness of a door frame is not deep enough to contain the strike plate 70 and the magnetic element 72, the conventional magnetic locking apparatus cannot be assembled on the door frame and this will limit the practicality of the conventional magnetic locking apparatus.

SUMMARY OF THE INVENTION

The main objective of the present invention is to provide a magnetic locking apparatus that can be assembled on a door conveniently.

The magnetic locking apparatus in accordance with the present invention has a body and an engaging mount. The body has a casing, a bolt and a driving device. The bolt is retractably mounted in the casing and has a connecting section, an engaging section and at least one magnetic element. The driving device is mounted in the casing and has a handle mount. The engaging mount faces the casing and the bolt and has a locking hole and at least one magnetic element mounted at two sides of the locking hole to attract the at least one magnetic element of the bolt.

Other objectives, advantages and novel features of the invention will become more apparent from the following detailed description when taken in conjunction with the accompanying drawings.

DETAILED DESCRIPTION OF PREFERRED EMBODIMENT

Figure 1:
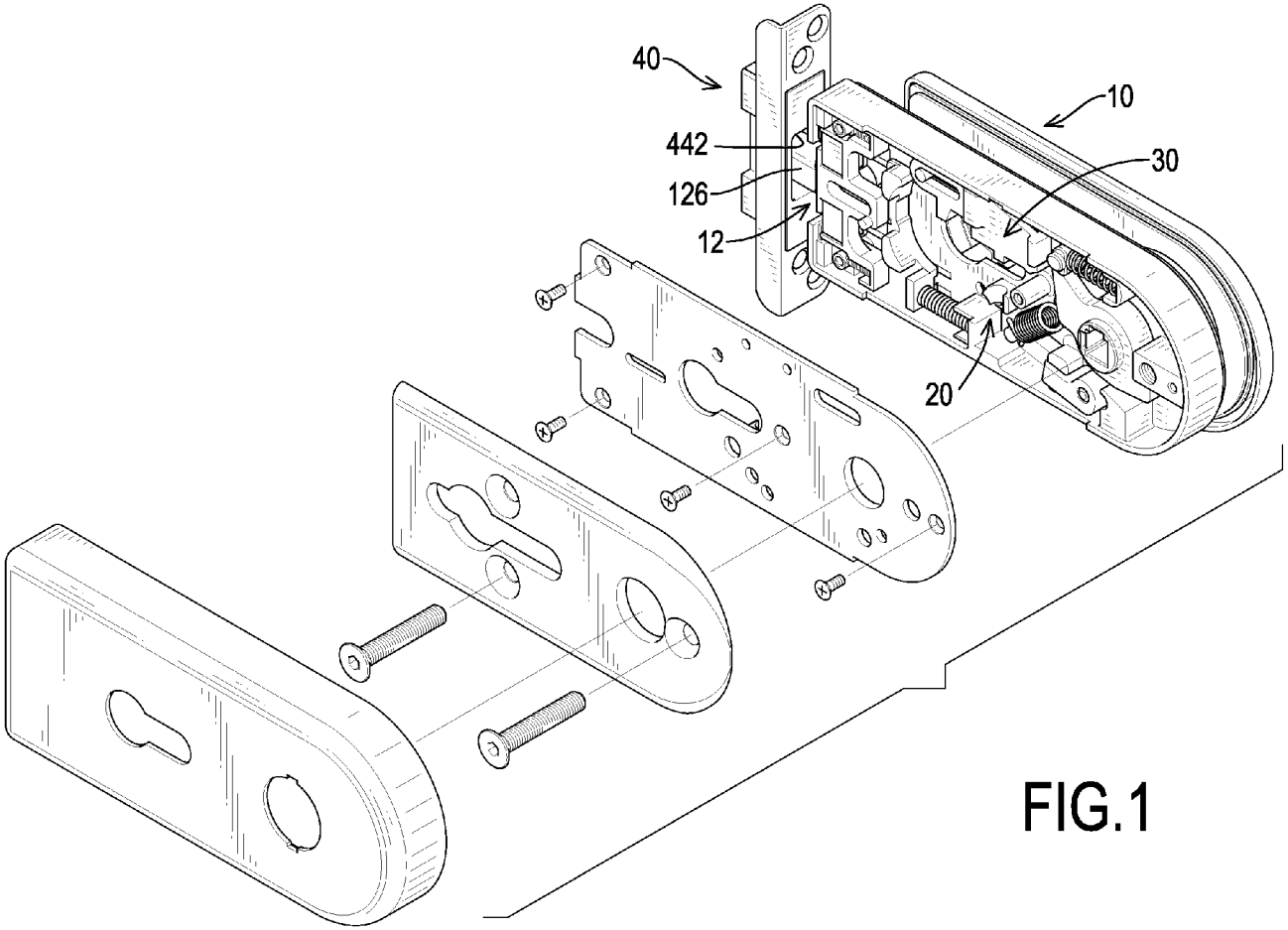
FIG. 1 is an exploded perspective view of a first embodiment of a magnetic locking apparatus in accordance with the present invention.
Figure 2:
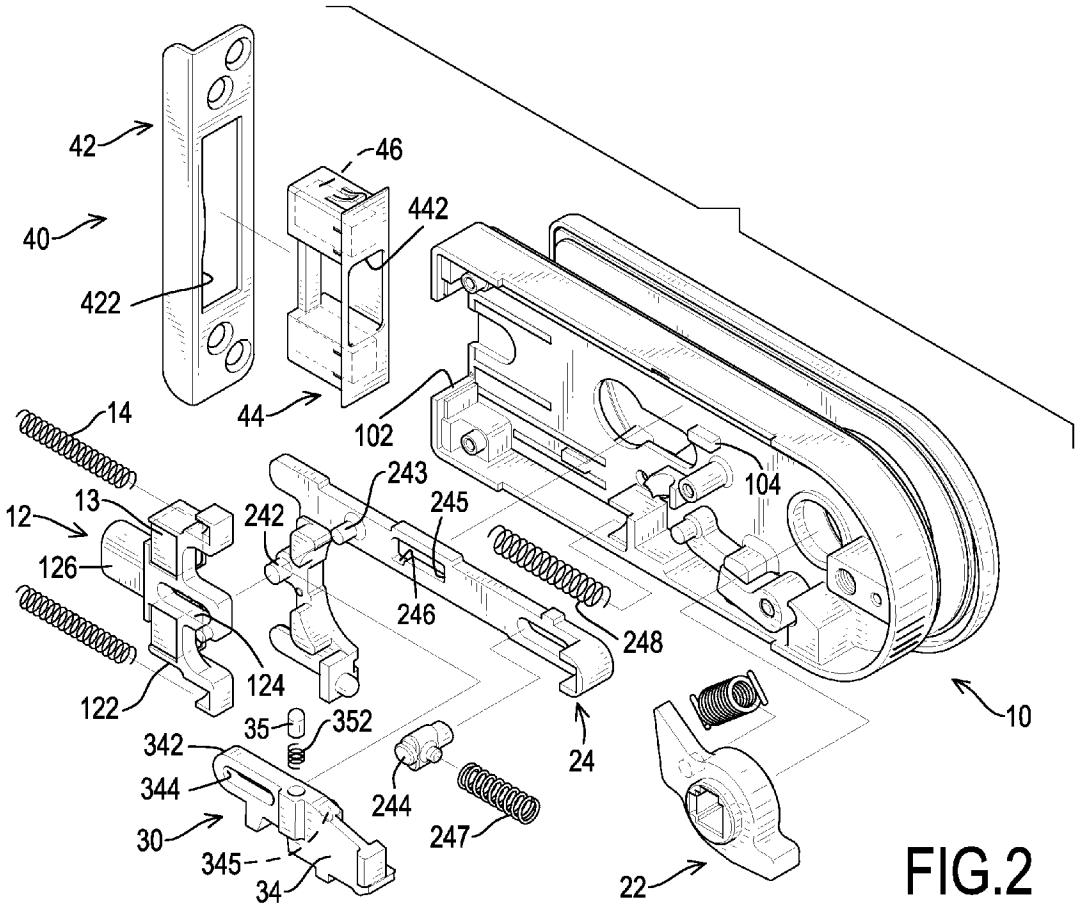
FIG. 2 is an exploded perspective view of a body and an engaging mount of the magnetic locking apparatus in FIG. 1.
Figure 3:
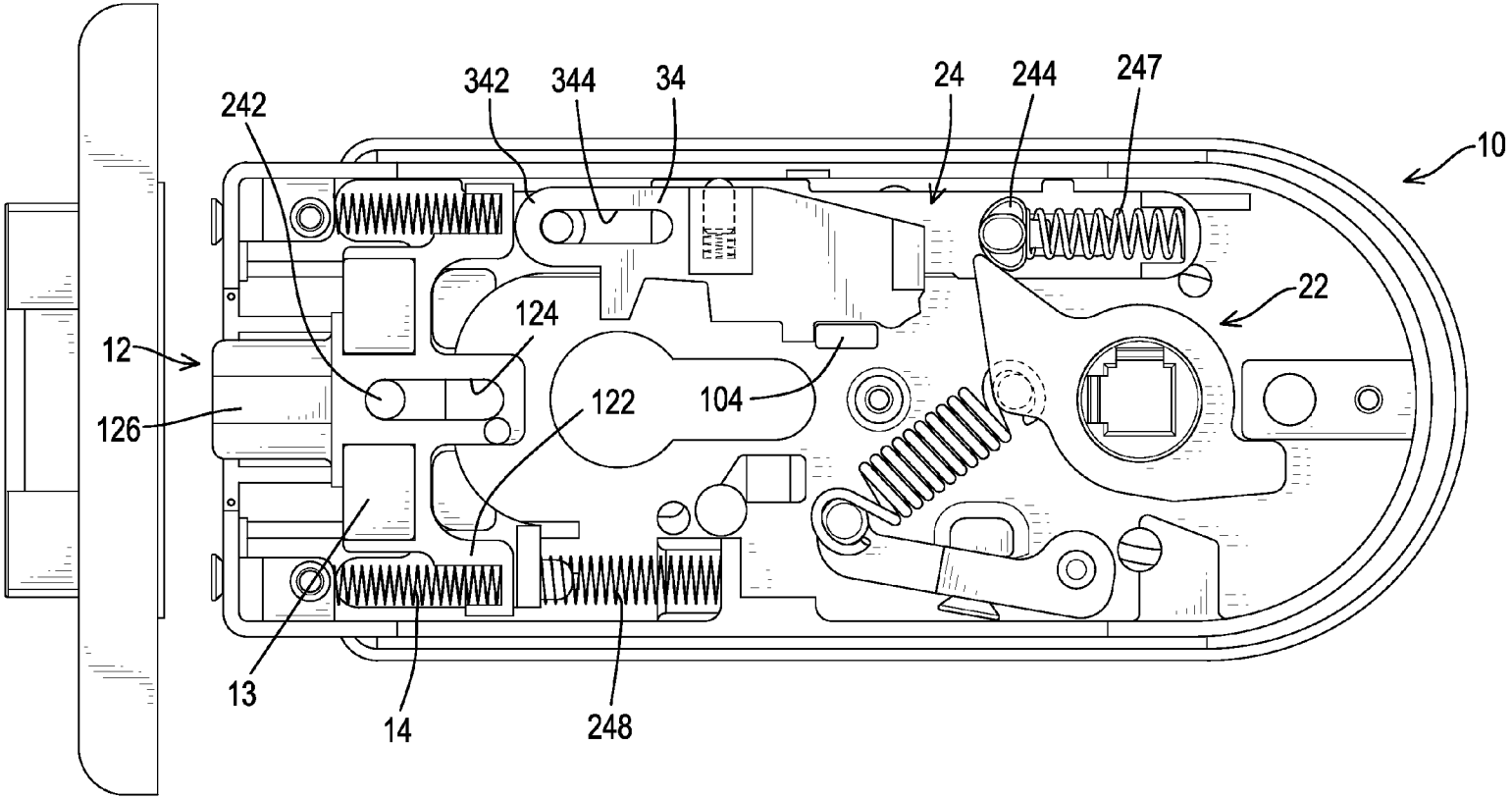
FIG. 3 is an operational side view of the magnetic locking apparatus in FIG. 2 showing a bolt of the magnetic locking apparatus being retracted into a casing of the magnetic locking apparatus.

With reference to FIGS. 1 to 3, a first embodiment of a magnetic locking apparatus in accordance with the present invention comprises a body and an engaging mount 40. The body is mounted in a door and has a casing 10, a bolt 12, at least one bolt spring 14 and a driving device 20.

The casing 10 can be composed of a base and a cover, and has a bolt end, a handle end, a bolt-hole 102 and a limiting-block 104. The bolt-hole 102 is formed through the bolt end of the casing 10. The limiting-block 104 is formed in the casing 10 near the handle end.

The bolt 12 is retractably mounted in the casing 10, extends out of the casing 10 via the bolt-hole 102 and has a connecting section 122 and an engaging section 126. The connecting section 122 of the bolt 12 is movably mounted in the casing 10 and has two magnetic elements 13 and an elongated guiding hole 124. The magnetic elements 13 are mounted in the connecting section 122. The guiding hole 124 is formed through the connecting section 122 between the magnetic elements 13. The engaging section 126 is formed with the connecting section 122 between the magnetic elements 13, is opposite to the guiding hole 124 and extends out of the casing 10 via the bolt-hole 102.

The at least one bolt spring 14 is mounted between the casing 10 and the bolt 12 to provide a retraction force to the bolt 12. Preferably, the body has two bolt springs 14 mounted between the casing 10 and the connecting section 122.

The driving device 20 is mounted in the casing 10 to enable the bolt 12 to retract into the casing 10 and has a handle mount 22 and a bolt base 24. The handle mount 22 is rotatably mounted in the casing 10 near the handle end.

The bolt base 24 is mounted in the casing 10 between the bolt 12 and the handle mount 22 and can be moved by the handle mount 22. Furthermore, the bolt base 24 is connected to the bolt 12 and has a connected end, an abutting end, an inner side, an outer side, a guiding rod 242, a leading post 243, a driven block 244, a block spring 247, an engaging slot 245, a positioning recess 246 and a bolt-base spring 248.

The connecting end of the bolt base 24 is moveably connected to the bolt 12. The abutting end of the bolt base 24 abuts the handle mount 22. The inner side of the bolt base 24 movably abuts the casing 10. The guiding rod 242 is formed on and protrudes from the outer side of the bolt base 24 at the connecting end and is slidably mounted in the guiding hole 124. The leading post 243 is formed on and protrudes from the outer side of the bolt base 24 near the guiding rod 242. The driven block 244 is movably mounted in the abutting end of the bolt base 24. The block spring 247 is mounted between the driven block 244 and the abutting end of the bolt base 24.

Figure 5:
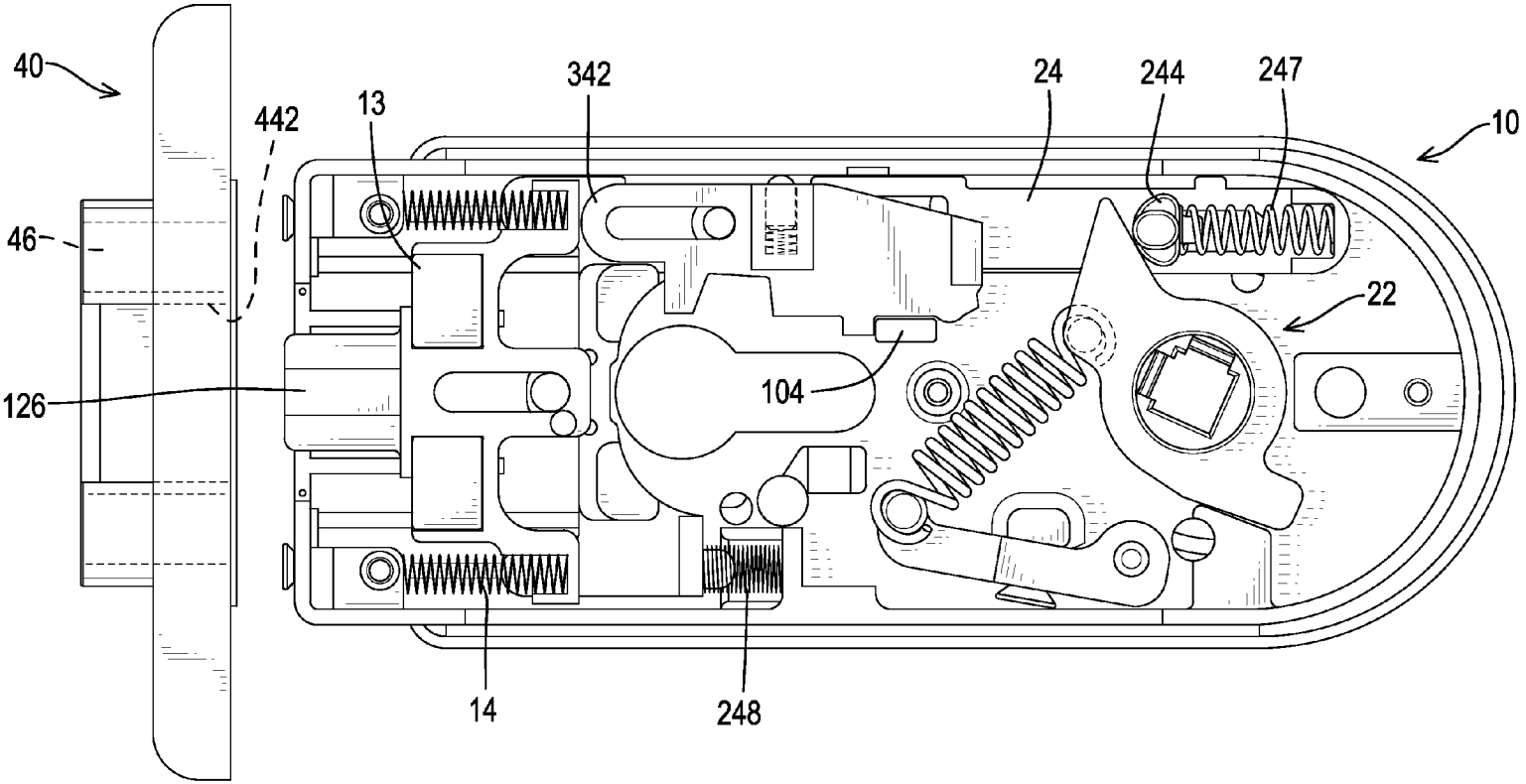
FIG. 5 is an operational side view of the magnetic locking apparatus in FIG. 2 showing the bolt of the magnetic locking apparatus being retracted into the casing of the magnetic locking apparatus in an unlocked condition by a driving device of the magnetic locking apparatus.

The engaging slot 245 is formed through the sides of the bolt base 24 near the leading post 243 and has a frond end facing the bolt 12. The positioning recess 246 is formed in the front end of the engaging slot 245. The bolt-base spring 248 is mounted between the bolt base 24 and the casing 10 below the leading post 243. In addition, the elastic coefficient of the block spring 247 is larger than the elastic coefficient of the bolt-base spring 248. With further reference to FIG. 5, when the handle mount 22 is rotated by a user, the handle mount 22 is pushed against the driven block 244. Because the elastic coefficient of the block spring 247 is larger than the elastic coefficient of the bolt-base spring 248, before the block spring 247 is compressed, the bolt-base spring 248 is compressed. Accordingly, the bolt base 24 can be moved relative to the casing 10 by the handle mount 22.

The engaging mount 40 is mounted in a side of a door frame, aligns with the bolt-hole 102 and the bolt 12 when the door is closed relative to the door frame and has a mounting board 42 and a locking base 44. The mounting board 42 is securely mounted on a side of the door frame, faces the bolt end of the casing 10 and has an elongated mounting hole 422 formed through the mounting board 42. The locking base 44 is securely mounted in the mounting hole 422, faces the bolt 12 and has a central section, a top section, a bottom section, a locking hole 442 and two magnetic elements 46. The locking hole 442 is formed through the central section of the locking base 44 between the top section and the bottom section of the locking base 44 to enable the bolt 12 to move into the locking base 44 when the door is closed relative to the door frame. The magnetic elements 46 are respectively mounted in the top section and the bottom section of the locking base 44 and respectively align with the magnetic elements 13. In addition, the magnetic elements 46 can be a permanent magnet or an electromagnet. The user can control the magnetic elements 46 by energizating to generate a magnetic force of the magnetic elements 46 and to cope with the opening and closing action required.

Figure 4:
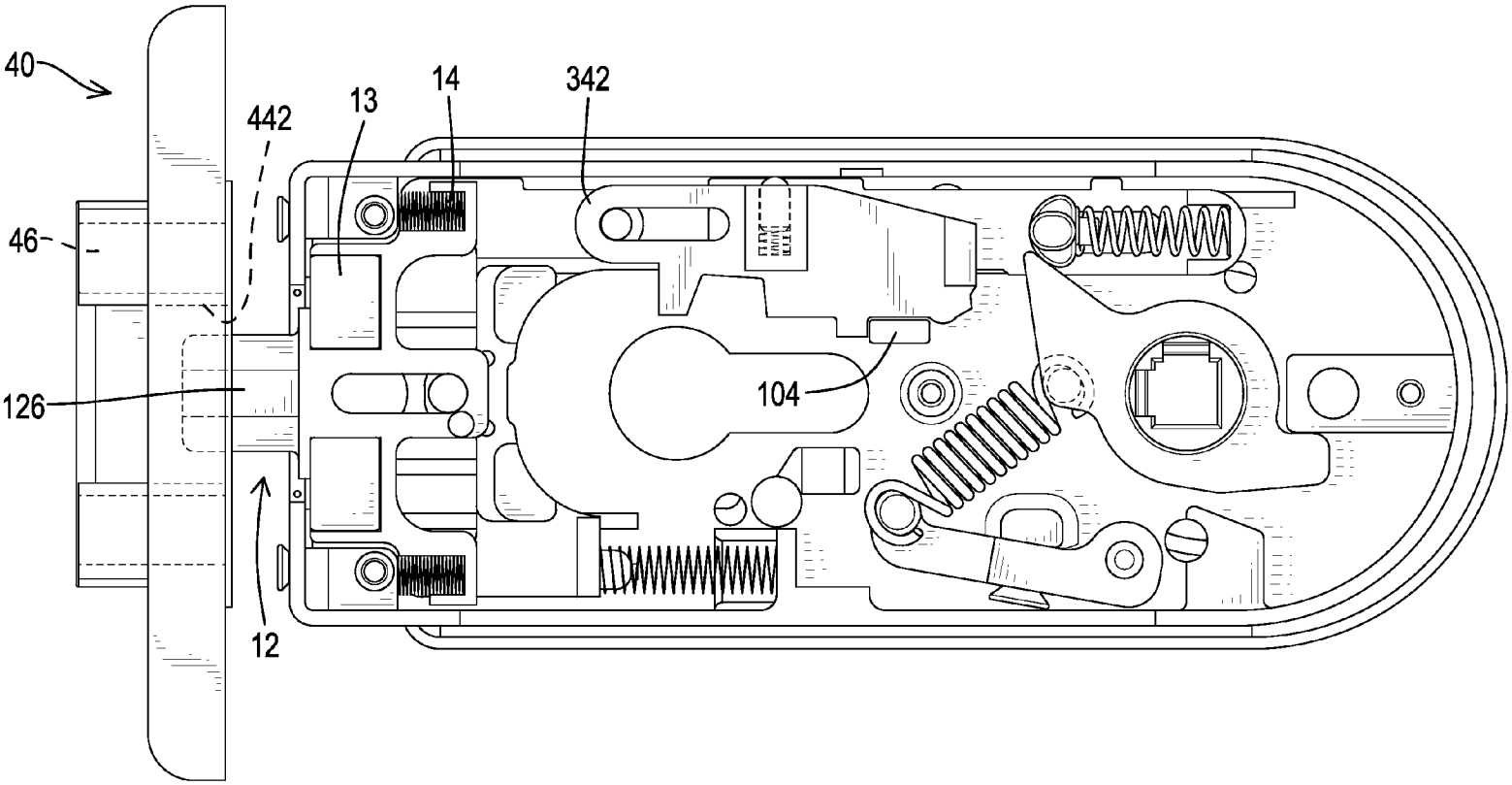
FIG. 4 is an operational side view of the magnetic locking apparatus in FIG. 2 showing the bolt of the magnetic locking apparatus being extended out of the casing of the magnetic locking apparatus in a locked condition.

When the door is opened, with reference to FIG. 3, the bolt 12 is retracted inside the casing 10 by a pushing force of the at least one bolt spring 14. When the door is rotated to close relative to the door frame, the bolt 12 is retracted into the casing 10 such that the bolt 12 does not knock against the engaging mount 40. When the door is completely closed relative to the door frame to enable the bolt 12 to align with the locking hole 442 the magnetic elements 13, 46 that are mounted on the bolt 12 and the locking base 44 will attract each other. Then, the engaging section 126 will be moved out of the casing 10 via the bolt-hole 102 and will be inserted into the locking hole 442. With reference to FIG. 4, when the engaging section 126 engages in the locking hole 442, the door cannot be rotated relative to the door frame and the door is set in a closed condition.

With reference to FIG. 5, when the user wants to open the door, the handle mount 22 is rotated relative to the casing 10, and the bolt base 24 will be moved relative to the casing 10 by the handle mount 22 pushing against the driven block 244. Then, the bolt 12 will be moved with the bolt base 24 and will be retracted into the casing 10. Therefore, when the user opens and rotates the door relative to the door frame, the bolt 12 is fully retracted into the casing 10 by the at least one bolt spring 14 and does not knock against the engaging mount 40.

Because the magnetic elements 46 are respectively mounted in the top section and the bottom section of the mounting board 42 beside the locking hole 442 such that the thickness of the engaging mount 40 is not increased and the engaging mount 40 can be assembled on the conventional door frame without increasing the depth of the door frame. Consequently, the magnetic locking apparatus can be assembled on a thinner door frame and this will increase the convenience and the practicality in assembly.

Figure 6:
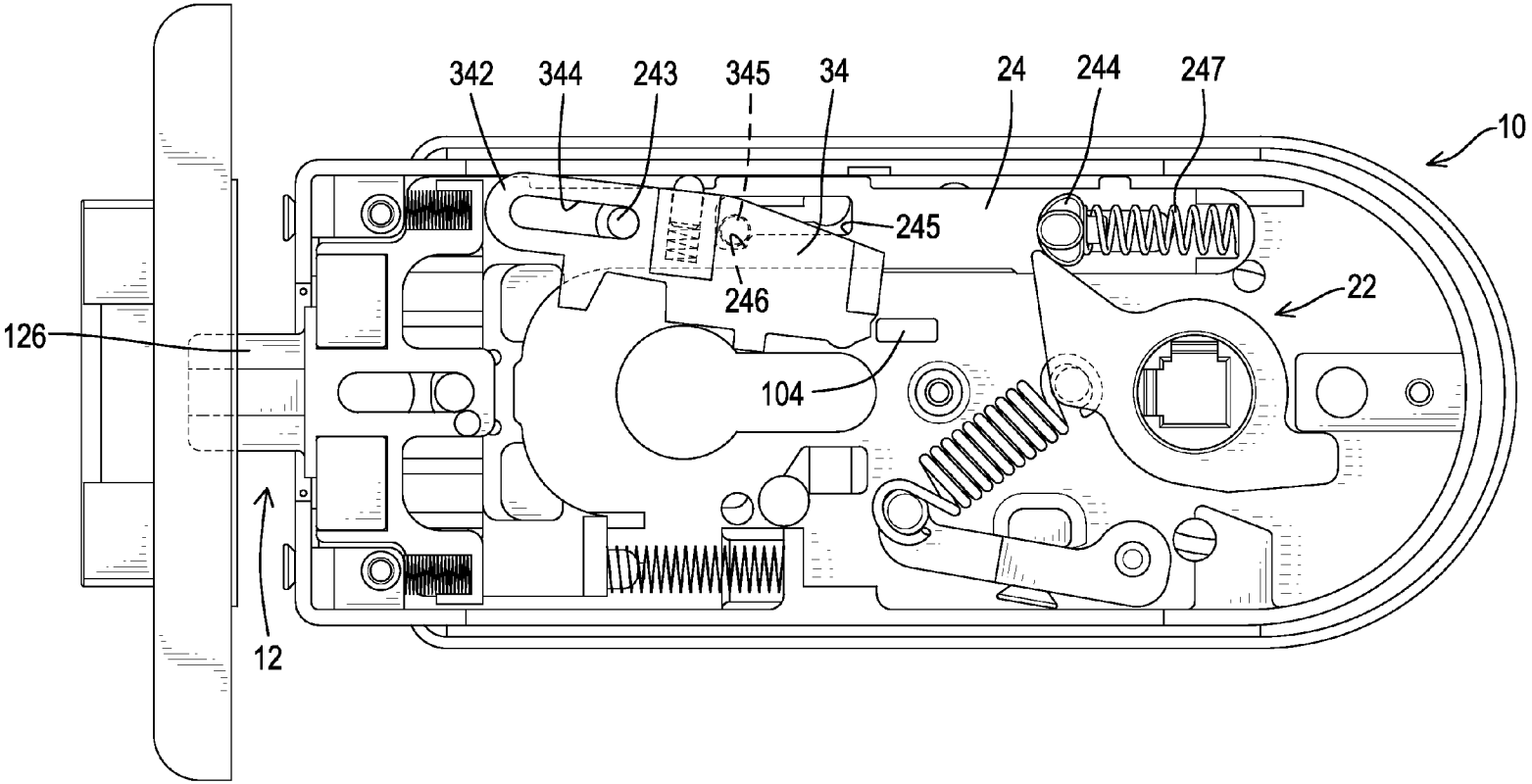
FIG. 6 is an operational side view of the magnetic locking apparatus in FIG. 2 showing the magnetic locking apparatus being set in a locked condition by a bolt mechanism of the magnetic locking apparatus.

Additionally, with reference to FIGS. 2, 3 and 6, the body of the magnetic locking apparatus further has a locking mechanism 30 mounted in the casing 10 between the bolt 12 and the driving device 20. The locking mechanism 30 has a locking bar 34 movably mounted in the casing 10. Furthermore, the locking bar 34 is movably mounted on the bolt base 24 and has an abutting end 342, a limiting end, a leading hole 344 and a holding rod 345. The abutting end 342 abuts the bolt 12. The limiting end faces the limiting-block 104. The leading hole 344 is elongated, is formed through the locking bar 34 and is mounted around the leading post 243. When a corresponding key is inserted into the lock cylinder and rotated, the abutting end 342 abuts the bolt 12 and the limiting end of the locking bar 34 abuts against the limiting-block 104. Then, the bolt 12 cannot be inadvertently retracted into the casing 10.

Furthermore, the holding rod 345 is formed on and protrudes from the locking bar 34, is movably mounted in the engaging slot 245 and selectively engages in the positioning recess 246. In addition, the locking bar 34 has a pushing rod 35 movably mounted on the locking bar 34 and abutting against the casing 10. The locking bar 34 has a pushing spring 352 mounted between the locking bar 34 and the pushing rod 35. When the locking bar 34 is moved relative to the bolt base 24, the holding rod 345 is moved along the engaging slot 245. As the holding rod 345 is moved at the positioning recess 246, the pushing spring 352 will provide an elastic force to the pushing rod 35 and the locking bar 34. Accordingly, the locking bar 34 will be rotated relative to the bolt base 24 to enable the holding rod 345 to be located in the positioning recess 246. At the same time, the limiting end of the locking bar 34 faces and abuts the limiting-block 104 such that the locking bar 34 can be held securely between the bolt base 24 and the limiting-block 104 to prevent the bolt 12 from moving relative to the casing 10, and this can provide a firmly locking effect to the door in a locked condition.

When a user wants to rotate the handle or the rotating button in a locked condition, the handle mount 22 will press against the driven block 244 to move the bolt base 24 and to compress the block spring 247, but the bolt base 24 will not move relative to the casing 10. Then, the bolt 12 is kept out of the casing 10, is still mounted in the locking hole 442 and this will make the handle or the rotating button rotate idly.

When the corresponding key is inserted into the lock cylinder and rotated reversely, the locking bar 34 will move reversely relative to the bolt base 24 to enable the holding rod 345 to disengage from the positioning recess 246, and the locking bar 34 will move away from the bolt 12 and limiting-block 104. Then, the bolt 12 can be moved relative to the casing 10, and the user can rotate the handle mount 22 to enable the bolt 12 to retract into the casing 10. When the bolt 12 is retracted into the casing 10, the door can be rotated relative to the door frame and is set in an unlocked condition.

Figure 7:
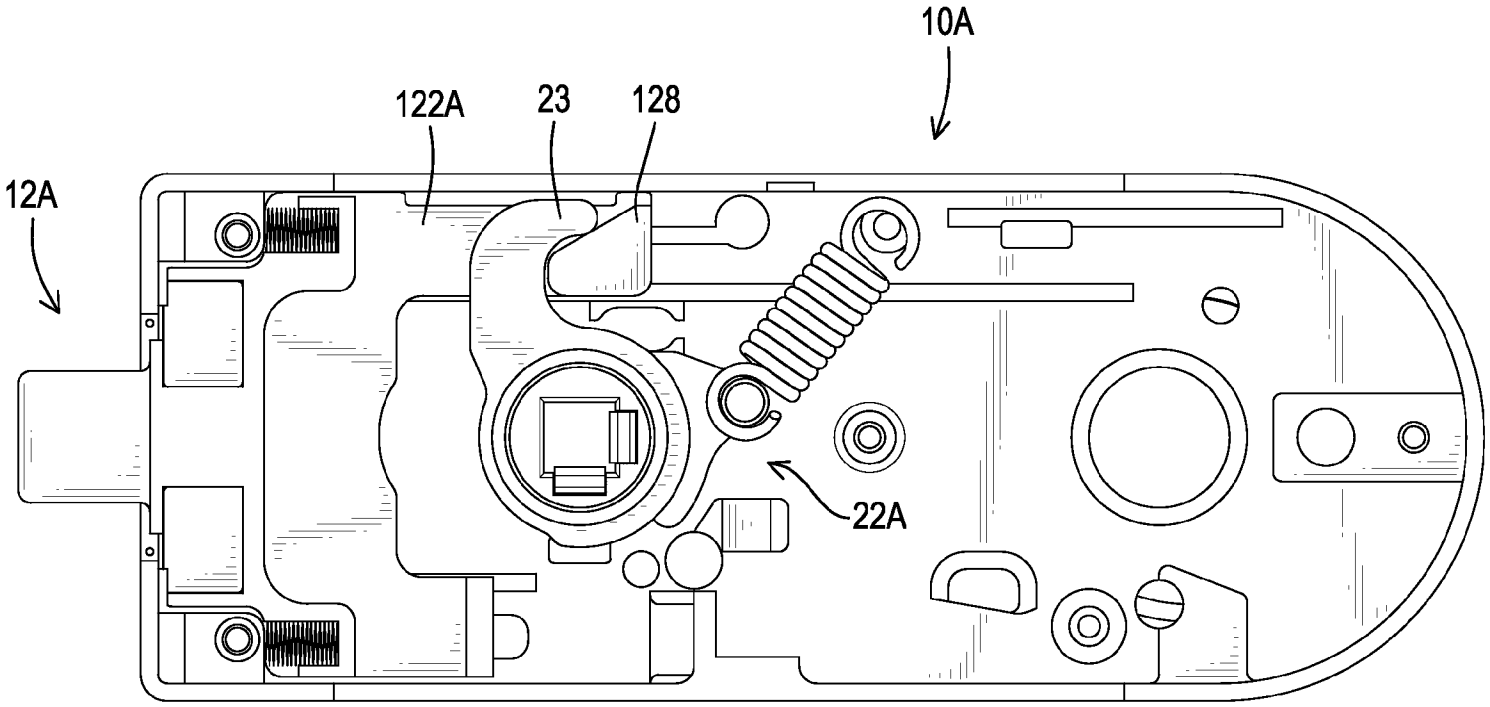
FIG. 7 is a side view of a second embodiment of a magnetic locking apparatus in accordance with the present invention.

With reference to FIG. 7, in a second embodiment of a magnetic locking apparatus in accordance with the present invention, the bolt 12A can be retracted into the casing 10A directly by the handle mount 22A. The bolt 12A has a driven block 128 formed on and protruding from the connecting section 122A. The handle mount 22A has a pulling arm 23 curvedly formed on and protruding from the handle mount 22A. When the user rotates the handle mount 22A via the handle or the rotating button, the pulling arm 23 of the handle mount 22A will press against the driven block 128 to directly retract the bolt 12A into the casing 10A to open the door. The above-mentioned features and structural relationships of the second embodiment of a magnetic locking apparatus in accordance with the present invention can be assembled with different use and design requirements.

Figure 8:
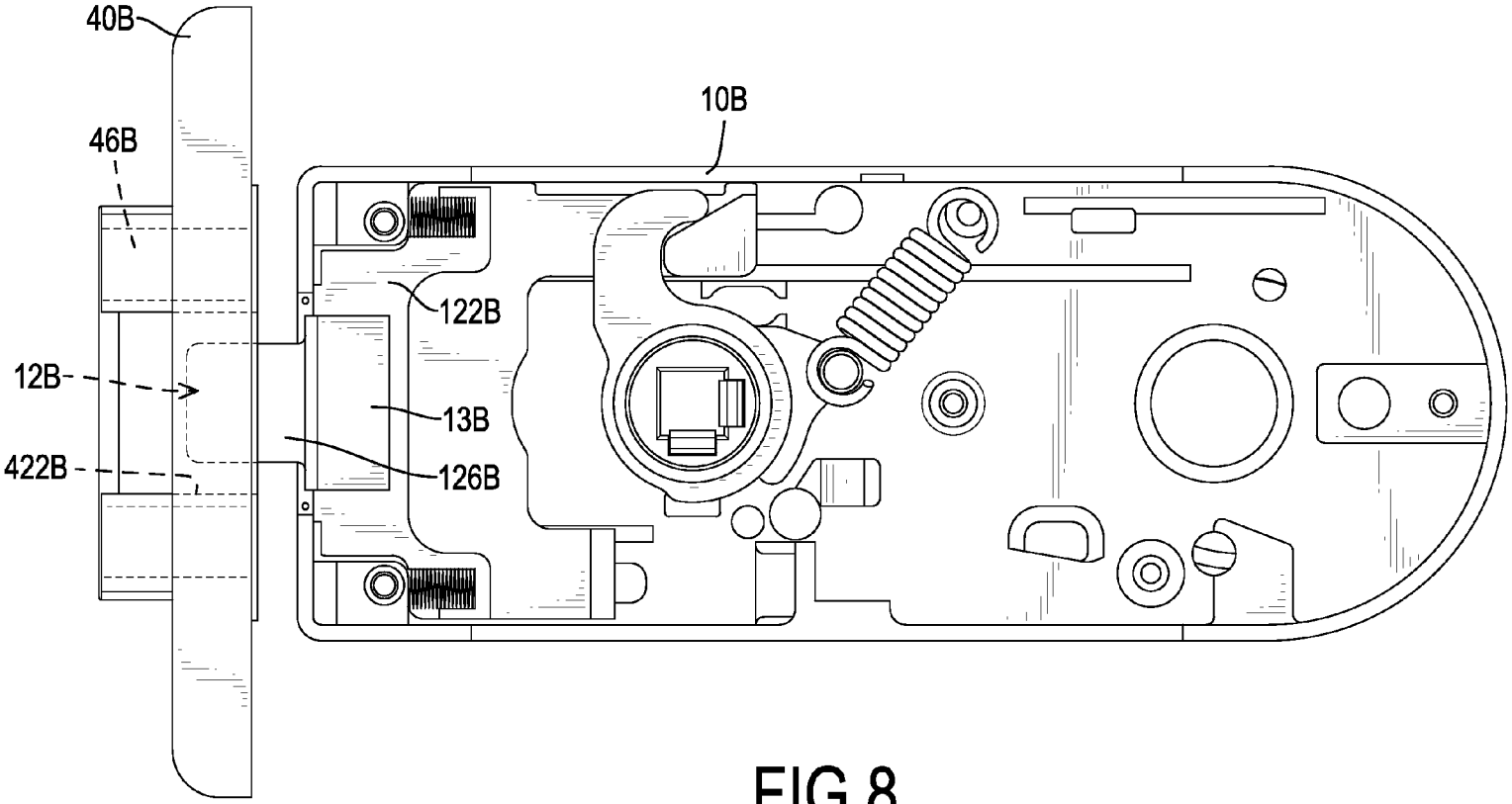
FIG. 8 is a side view of a third embodiment of a magnetic locking apparatus in accordance with the present invention.
Figure 9:
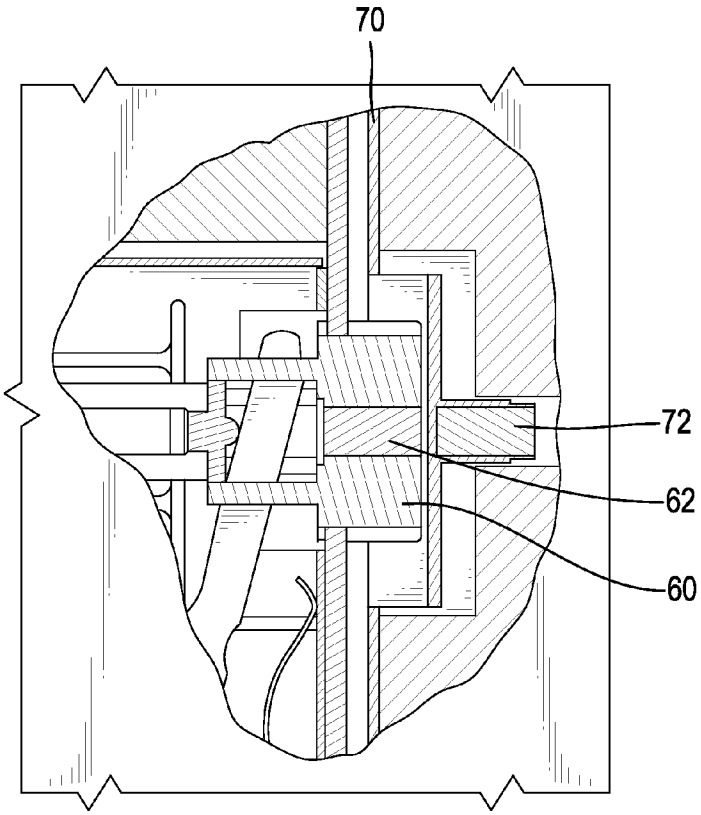
FIG.9 PRIOR ART
FIG. 9 is an enlarged cross sectional side view of a magnetic locking apparatus in accordance with the prior art mounted between a door and a door frame.

With further reference to FIG. 8, in a third embodiment of a magnetic locking apparatus in accordance with the present invention, the bolt 12B further has a magnetic element 13B. The magnetic element 13B is mounted on the connecting section 122B corresponding to the engaging section 126B. When the door is closed relative to the door frame, the bolt 12B will align with the locking hole 442B and the magnetic forces between the magnetic elements 13B, 46B will enable the bolt 12B to move out of the casing 10B and to enable the engaging section 126B to engage in the locking hole 442B. In addition, when the engaging section 126B engages in the locking hole 442B, the magnetic element 13B is still mounted in the casing 10B and the magnetic forces between the magnetic elements 13B, 46B can push and hold the engaging section 126B stably in the locking hole 442B. Then, the third embodiment of a magnetic locking apparatus in accordance with the present invention can provide a preferred locking effect to the door.

What is claimed is:

1. A magnetic locking apparatus comprising:

a body, the body having a casing, a bolt, at least one bolt spring and a driving device, the casing having a bolt end, a handle end and a bolt-hole formed through the bolt end of the casing, the bolt retractably mounted in the casing and having a connecting section, an engaging section and at least one magnetic element, the engaging section formed on an end of the connecting section and extending out of the casing via the bolt-hole, the at least one magnetic element mounted on the connecting section, the at least one bolt spring mounted between the casing and the bolt, the driving device mounted in the casing and having a handle mount, the handle mount rotatably mounted in the casing and connected to and retracting the bolt into the casing; and an engaging mount, the engaging mount facing the bolt-hole of the casing and the bolt and having a locking hole and two magnetic elements mounted respectively at two sides of the locking hole to attract the at least one magnetic element of the bolt, wherein the magnetic locking apparatus has a locking mechanism mounted in the casing of the body between the bolt and the driving device, the locking mechanism has a locking bar movably mounted in the casing and abutting the bolt.

2. The magnetic locking apparatus as claimed in claim 1, wherein the bolt has two magnetic elements, the magnetic elements of the bolt are mounted in the connecting section beside the engaging section of the bolt.

3. The magnetic locking apparatus as claimed in claim 2, wherein the bolt has an elongated guiding hole formed through the connecting section;

and the driving device has a bolt base movably mounted in the casing, the bolt base has a connected end moveably connected to the bolt, an abutting end corresponding to the handle mount, an inner side movably abutting the casing, an outer side and a guiding rod formed on and protruding from the outer side of the bolt base at the connecting end of the bolt base and slidably mounted in the guiding hole of the bolt.

4. The magnetic locking apparatus as claimed in claim 3, wherein the engaging mount has a mounting board facing the bolt end of the casing with an elongated mounting hole formed through the mounting board and a locking base securely mounted in the mounting hole of the mounting board and facing the bolt; and the locking hole of the engaging mount is formed through a central section of the locking base.

5. The magnetic locking apparatus as claimed in claim 4, wherein the casing has a limiting-block formed in the casing near the handle end of the casing;

the bolt base has a leading post formed on and protruding from the outer side of the bolt base near the guiding rod, an engaging slot formed through the sides of the bolt base near the leading post and having a frond end facing the bolt and a positioning recess formed in the front end of the engaging slot; and the locking bar is movably mounted on the bolt base and has an abutting end abutting the bolt, a limiting end facing the limiting-block of the casing, a leading hole formed through the locking bar and mounted around the leading post of the bolt base and a holding rod formed on and protruding from the locking bar, movably mounted in the engaging slot of the bolt base and selectively engages in the positioning recess.

6. The magnetic locking apparatus as claimed in claim 2, wherein the casing has a limiting-block formed in the casing near the handle end of the casing;

the bolt base has a leading post formed on and protruding from the outer side of the bolt base near the guiding rod, an engaging slot formed through the sides of the bolt base near the leading post and having a frond end facing the bolt and a positioning recess formed in the front end of the engaging slot; and the locking bar is movably mounted on the bolt base and has an abutting end abutting the bolt, a limiting end facing the limiting-block of the casing, a leading hole formed through the locking bar and mounted around the leading post of the bolt base, and a holding rod formed on and protruding from the locking bar, movably mounted in the engaging slot of the bolt base and selectively engaging in the positioning recess.

7. The magnetic locking apparatus as claimed in claim 1, wherein the bolt has one magnetic element, the magnetic element of the bolt is mounted on the connecting section corresponding to the engaging section of the bolt.

8. The magnetic locking apparatus as claimed in claim 7, wherein the bolt has an elongated guiding hole formed through the connecting section; and the driving device has a bolt base movably mounted in the casing, the bolt base has a connected end moveably connected to the bolt, an abutting end corresponding to the handle mount, an inner side movably abutting the casing, an outer side and a guiding rod formed on and protruding from the outer side of the bolt base at the connecting end of the bolt base and slidably mounted in the guiding hole of the bolt.

9. The magnetic locking apparatus as claimed in claim 8, wherein the engaging mount has a mounting board facing the bolt end of the casing with an elongated mounting hole formed through the mounting board and a locking base securely mounted in the mounting hole of the mounting board and facing the bolt; and the locking hole of the engaging mount is formed through a central section of the locking base.

10. The magnetic locking apparatus as claimed in claim 9, wherein the magnetic locking apparatus has a locking mechanism mounted in the casing of the body between the bolt and the driving device, the locking mechanism has a locking bar movably mounted in the casing and abutting the bolt.

11. The magnetic locking apparatus as claimed in claim 10, wherein the casing has a limiting-block formed in the casing near the handle end of the casing;

the bolt base has a leading post formed on and protruding from the outer side of the bolt base near the guiding rod, an engaging slot formed through the sides of the bolt base near the leading post and having a frond end facing the bolt and a positioning recess formed in the front end of the engaging slot; and the locking bar is movably mounted on the bolt base and has an abutting end abutting the bolt, a limiting end facing the limiting-block of the casing, a leading hole formed through the locking bar and mounted around the leading post of the bolt base and a holding rod formed on and protruding from the locking bar, movably mounted in the engaging slot of the bolt base and selectively engages in the positioning recess.

12. The magnetic locking apparatus as claimed in claim 7, wherein the magnetic locking apparatus has a locking mechanism mounted in the casing of the body between the bolt and the driving device, and the locking mechanism has a locking bar movably mounted in the casing and abutting the bolt.

13. The magnetic locking apparatus as claimed in claim 12, wherein the casing has a limiting-block formed in the casing near the handle end of the casing;

the bolt base has a leading post formed on and protruding from the outer side of the bolt base near the guiding rod, an engaging slot formed through the sides of the bolt base near the leading post and having a frond end facing the bolt and a positioning recess formed in the front end of the engaging slot; and the locking bar is movably mounted on the bolt base and has an abutting end abutting the bolt, a limiting end facing the limiting-block of the casing, a leading hole formed through the locking bar and mounted around the leading post of the bolt base, and a holding rod formed on and protruding from the locking bar, movably mounted in the engaging slot of the bolt base and selectively engaging in the positioning recess.

14. The magnetic locking apparatus as claimed in claim 1, wherein the bolt has an elongated guiding hole formed through the connecting section; and the driving device has a bolt base movably mounted in the casing, the bolt base has a connected end moveably connected to the bolt, an abutting end corresponding to the handle mount, an inner side movably abutting the casing, an outer side and a guiding rod formed on and protruding from the outer side of the bolt base at the connecting end of the bolt base and slidably mounted in the guiding hole of the bolt.

15. The magnetic locking apparatus as claimed in claim 14, wherein the engaging mount has a mounting board facing the bolt end of the casing with an elongated mounting hole formed through the mounting board and a locking base securely mounted in the mounting hole of the mounting board and facing the bolt; and the locking hole of the engaging mount is formed through a central section of the locking base.

16. The magnetic locking apparatus as claimed in claim 15, wherein the casing has a limiting-block formed in the casing near the handle end of the casing;

the bolt base has a leading post formed on and protruding from the outer side of the bolt base near the guiding rod, an engaging slot formed through the sides of the bolt base near the leading post and having a frond end facing the bolt and a positioning recess formed in the front end of the engaging slot; and the locking bar is movably mounted on the bolt base and has an abutting end abutting the bolt, a limiting end facing the limiting-block of the casing, a leading hole formed through the locking bar and mounted around the leading post of the bolt base and a holding rod formed on and protruding from the locking bar, movably mounted in the engaging slot of the bolt base and selectively engages in the positioning recess.

17. The magnetic locking apparatus as claimed in claim 1, wherein the casing has a limiting-block formed in the casing near the handle end of the casing;

the bolt base has a leading post formed on and protruding from the outer side of the bolt base near the guiding rod, an engaging slot formed through the sides of the bolt base near the leading post and having a frond end facing the bolt and a positioning recess formed in the front end of the engaging slot; and the locking bar is movably mounted on the bolt base and has an abutting end abutting the bolt, a limiting end facing the limiting-block of the casing, a leading hole formed through the locking bar and mounted around the leading post of the bolt base, and a holding rod formed on and protruding from the locking bar, movably mounted in the engaging slot of the bolt base and selectively engaging in the positioning recess.

* * * * *